US005974623A

United States Patent [19]

Cummins et al.

[11] Patent Number: 5,974,623

[45] Date of Patent: Nov. 2, 1999

[54] VACUUM CLEANER MOTOR HOUSING

[75] Inventors: Craig Richard Cummins, Manton; Dean Robert Rohn, Cadillac, both of Mich.

[73] Assignee: Rexair, Inc., Troy, Mich.

[21] Appl. No.: 09/018,068

[22] Filed: Feb. 4, 1998

[51] Int. Cl.[6] ..... A47L 9/10

[52] U.S. Cl. ..... 15/347; 15/412; 15/413

[58] Field of Search ..... 15/412, 413, 327.1, 15/347, 353; 55/470, 472

[56] References Cited

U.S. PATENT DOCUMENTS

| | | | |
|---|---|---|---|
| 2,272,985 | 2/1942 | Smith | 15/412 |
| 2,314,334 | 3/1943 | Frantz | 15/413 |
| 2,987,241 | 6/1961 | Lindsjo et al. | 15/412 |
| 3,780,397 | 12/1973 | Harbeck et al. | 15/413 |
| 3,866,263 | 2/1975 | Crouser et al. | 15/412 |
| 4,633,543 | 1/1987 | Sovis et al. | 15/413 |
| 4,640,697 | 2/1987 | Erickson, Jr. . | |
| 4,824,333 | 4/1989 | Erickson, Jr. . | |
| 4,864,683 | 9/1989 | Herron, Jr. et al. . | |
| 4,978,281 | 12/1990 | Conger, IV . | |
| 5,421,058 | 6/1995 | Zahuranec et al. | 15/413 |
| 5,448,794 | 9/1995 | Walch et al. . | |
| 5,479,676 | 1/1996 | Martin et al. . | |
| 5,592,716 | 1/1997 | Moren et al. | 15/413 |
| 5,638,575 | 6/1997 | Sin | 15/344 |

FOREIGN PATENT DOCUMENTS

| | | | |
|---|---|---|---|
| 4-90733 | 3/1992 | Japan | 15/413 |

*Primary Examiner*—Robert J. Warden, Sr.
*Assistant Examiner*—Andrew Aldag
*Attorney, Agent, or Firm*—Howard & Howard

[57] ABSTRACT

A motor housing for a vacuum cleaner includes a motor chamber supported within a main housing wall. A first airway defined between the motor chamber and the main housing wall provides a pathway for the working air flow within the vacuum cleaner. A second airway is defined through the motor chamber by an inlet opening and a venting outlet. The airway through the motor chamber allows air to flow along and directly encounter the motor during vacuum operation. The air flow through the first airway not only serves as the working air flow, but also as a secondary cooling air flow because the air passes along the exterior surface of the motor chamber and provides a cooling effect.

17 Claims, 4 Drawing Sheets

VACUUM CLEANER MOTOR HOUSING

BACKGROUND OF THE INVENTION

This invention generally relates to a motor housing for a vacuum cleaner having air flow passageways for cooling the motor during vacuum cleaner operation.

A variety of vacuum cleaners exist on the market. One specialized type of vacuum cleaner is known as a liquid bath vacuum cleaner. While currently available liquid bath vacuum cleaners have proven effective and useful, those skilled in the art are always seeking to improve and enhance their function.

One challenge associated with designing a liquid bath vacuum cleaner is providing an arrangement for cooling the motor during operation. Since electric motors are typically used, it is necessary to cool such motors during operation or excessive heat may build up that can damage or disable the motor after some time. Conventional wisdom was to allow the working air (i.e. the air flow that draws debris into the vacuum cleaner) to pass through the motor housing in a way that would cool the motor during operation. A disadvantage associated with this solution is that some debris in the working air flow may encounter or become lodged in a working part of the motor, which introduces the possible need for repair. Though arrangements have been suggested for isolating a cooling air flow from the working air flow, such arrangements are not necessarily the most efficient in design or operation.

Accordingly, a need exists for an improved design and arrangement of components within a liquid bath vacuum cleaner for providing the necessary motor cooling effect. This invention provides a unique design that takes advantage of strategic placement of the working parts of the vacuum cleaner to achieve an enhanced motor cooling effect while avoiding the shortcomings and drawbacks of previous designs.

SUMMARY OF THE INVENTION

In general terms, this invention is a motor housing for a vacuum cleaner that includes a main housing wall having a first generally open end and a second generally open end. The main housing wall defines an outer perimeter of the housing. A motor chamber is supported within the main housing wall. The motor chamber includes at least one inlet and at least one venting outlet. A first airway is disposed between an interior surface on the main housing wall and an exterior surface on the motor chamber. The first airway permits air flow from the first end toward the second end of the main housing wall. A second airway is defined within the motor chamber and is isolated from the first airway. The second airway permits air flow from the inlet through the motor chamber toward the venting outlet.

The second airway is specifically dedicated to being a cooling airway for cooling the motor during vacuum operation. The first airway primarily functions as a working airway that directs the air flow through the vacuum cleaner that is responsible for drawing debris into the vacuum. The first airway also functions as a secondary cooling airway because the working air flow passes along the outside surface of the motor chamber and, therefore, provides a secondary cooling effect.

In the preferred embodiment, there are two channels for the working air flow to flow through the first airway. Further, there preferably are two inlets and two venting outlets defined in the motor chamber. The venting outlets preferably are offset from each other on opposite sidewalls of the motor chamber.

An additional feature of this invention is positioning the motor between the main fan assembly and the debris collecting portion of the vacuum cleaner. This arrangement is advantageous because it facilitates utilizing the working air flow, which is driven by the main fan assembly, as a secondary cooling air flow.

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
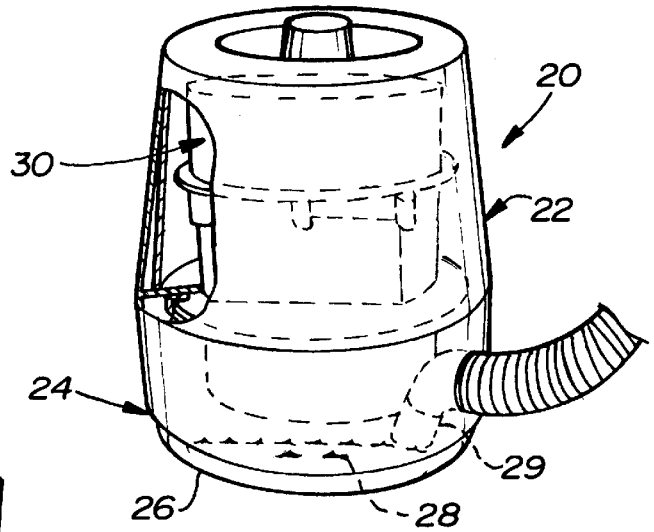
FIG. 1 is a perspective diagrammatic illustration of a vacuum cleaner having a motor housing designed according to this invention.

FIG. 1 diagrammatically illustrates a vacuum cleaner 20 having an exterior body 22. The lower end of the vacuum cleaner 20 includes a debris collection portion 24. The preferred embodiment of this invention is a liquid bath vacuum cleaner and, therefore, the debris collection portion includes a pan 26 that holds a selected volume of liquid 28. An inlet 29 provides the opening through which debris is drawn into the vacuum cleaner.

Figure 2:
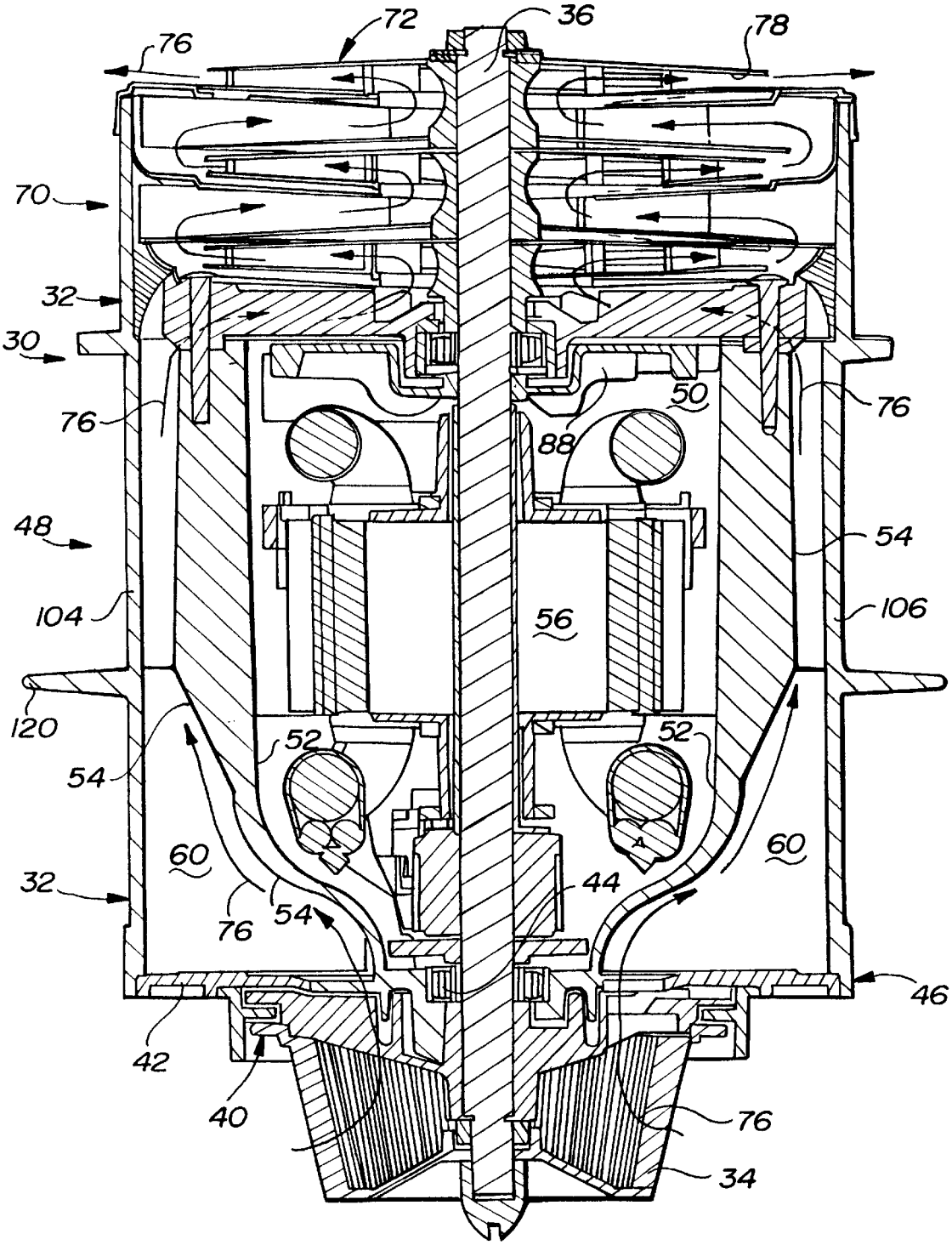
FIG. 2 is a cross-sectional illustration of a motor housing designed according to this invention.

A motor housing 30 is supported within the vacuum cleaner body 22 above the debris collection portion 24. As can be seen in FIG. 2, the motor housing 30 includes a main housing wall 32 that is generally open at both ends. It is useful to consider the motor housing 30 as having three portions.

A first portion of the housing 30 at the bottom of the drawing supports a separator 34 that rotates with a shaft 36 about its central longitudinal axis 38. The separator 34 operates in a conventional manner to insure that debris that is drawn in through the inlet 29 remains in the debris collecting portion 24 and does not protrude into other portions of the motor housing 30. A labyrinth seal 40 and an air deflector 42 further insure that the liquid 28 and any debris drawn in through the inlet 29 remain in the debris collecting portion 24. Additional sealing properties are provided by a sealing bearing 44, which is positioned at an interface between the rotating shaft 36 and a first portion 46 of the motor housing 30. The first portion 46 preferably is positioned immediately adjacent the debris collecting portion 24 and supports the sealing elements 40–44 and the separator 34.

A second portion 48 of the motor housing 30 contains a motor chamber 50. Sidewalls of the motor chamber 50 define an interior surface 52 and an exterior surface 54. The preferred embodiment includes an electric motor 56 supported within the motor chamber 50 so that when power is supplied to the motor 56, it drives or rotates the elongated shaft 36.

As best seen in FIG. 2, at least a portion of the motor chamber 50 is positioned within the main housing wall 32 of the motor housing 30. Accordingly, a first airway is provided between the exterior surface 54 of the motor chamber and the interior surface of the main housing wall 32. In the illustrated embodiment, two such airways 60 are positioned on opposite sides of the motor housing 30. In the most preferred embodiment, each of the airways 60 extends over approximately one quarter of the outer surface 54 of the motor chamber 50.

A third portion 70 of the motor housing 30, which is commonly referred to as a stage portion, supports a main fan assembly 72. Importantly, in the preferred embodiment of this invention, the motor 56 and the motor chamber 50 are positioned between the debris collecting portion 24 and the main fan assembly 72. This arrangement, which is unique to the motor housing 30 of this invention, provides advantages that will become apparent as this description proceeds.

The main fan assembly 72 is driven by the motor 56 so that as the shaft 36 rotates, the fan assembly 72 operates. Fan assembly 72 can be any conventional fan arrangement but preferably includes a plurality of channels 74 as generally illustrated and as are known in the art. When the fan assembly 72 operates, it generates a working air flow 76 that is responsible for drawing air and other substances into the inlet 29 of the vacuum cleaner 20. The working air flow 76 flows through the inlet 29, the separator 34 and along the airway defined by the chambers 60 on either side of the motor chamber 50. The working air flow 76 then snakes through the channels 74 of the main fan assembly 72 and is exhausted through an opening 78 at the top (according to the drawing) end of the motor housing 30. The vacuum cleaner body 22 preferably includes a plurality of venting slots or openings that allow the working air flow to escape outside of the vacuum cleaner and into the atmosphere. The venting slots in the body 22 can be louvered slots or other openings specifically designed for aesthetic appearance, for example.

Figure 3:
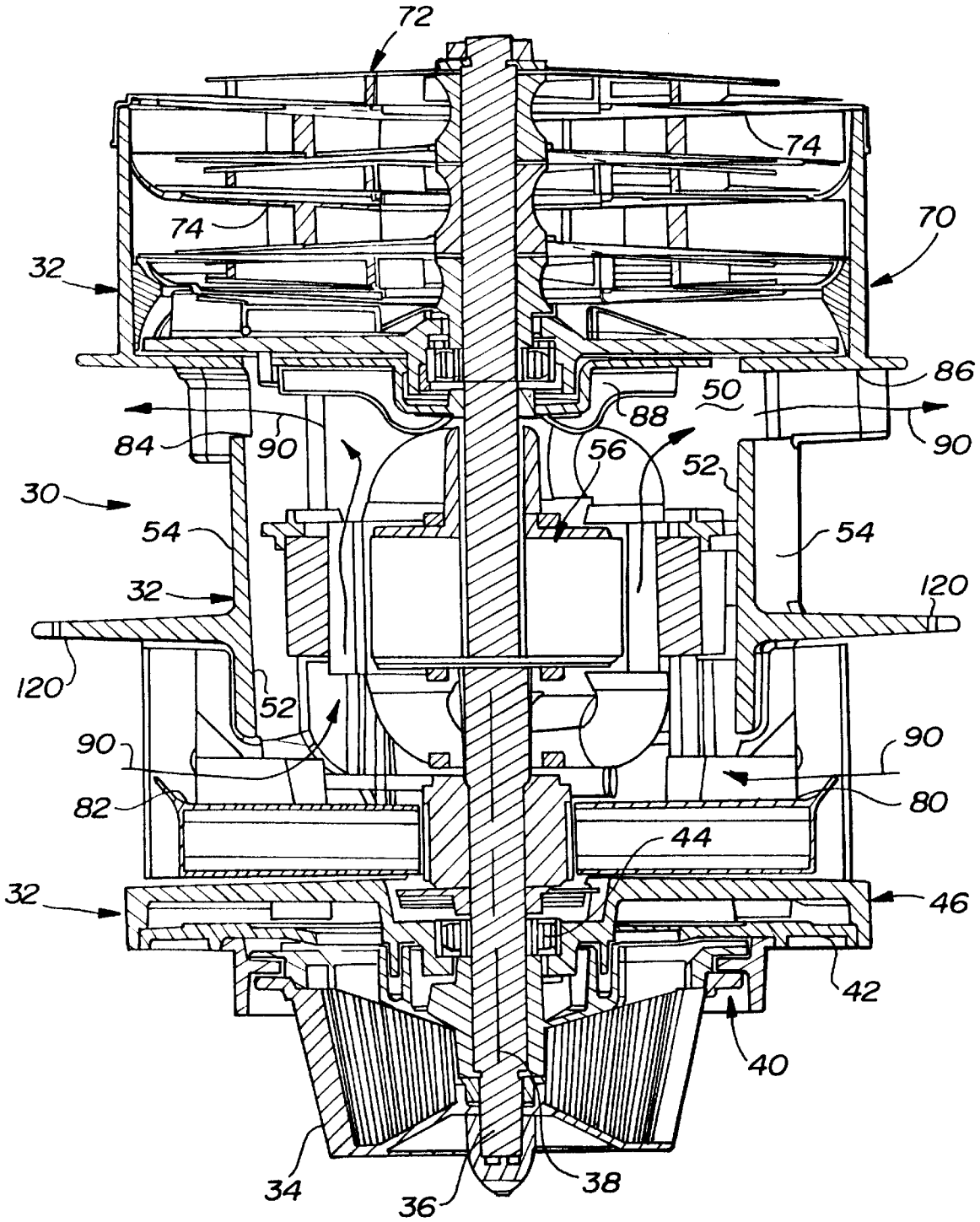
FIG. 3 is a cross-sectional illustration of the embodiment of FIG. 2 as seen from a 90° change of perspective.

FIG. 3 is a cross-sectional view of the preferred embodiment of this invention taken 90° away from the illustration of FIG. 2. The preferred shape of the motor housing 30 provides that the first airway 60 is not visible within the cross section of FIG. 3.

A second airway is provided through the motor chamber 50. A pair of inlets 80 and 82 preferably are defined at the lower end (according to the drawing) of the second portion 48 of the motor housing 30. The inlets 80 and 82 are formed as openings through the main housing wall 32 at an end of the second portion 48 that is near the first portion 46. In the illustration of FIG. 3 (and for reasons that will become more apparent when considering FIGS. 4 and 5) the exterior surface 54 of the motor chamber 50 is coincident with the exterior surface of the main housing wall 32.

Figure 6:
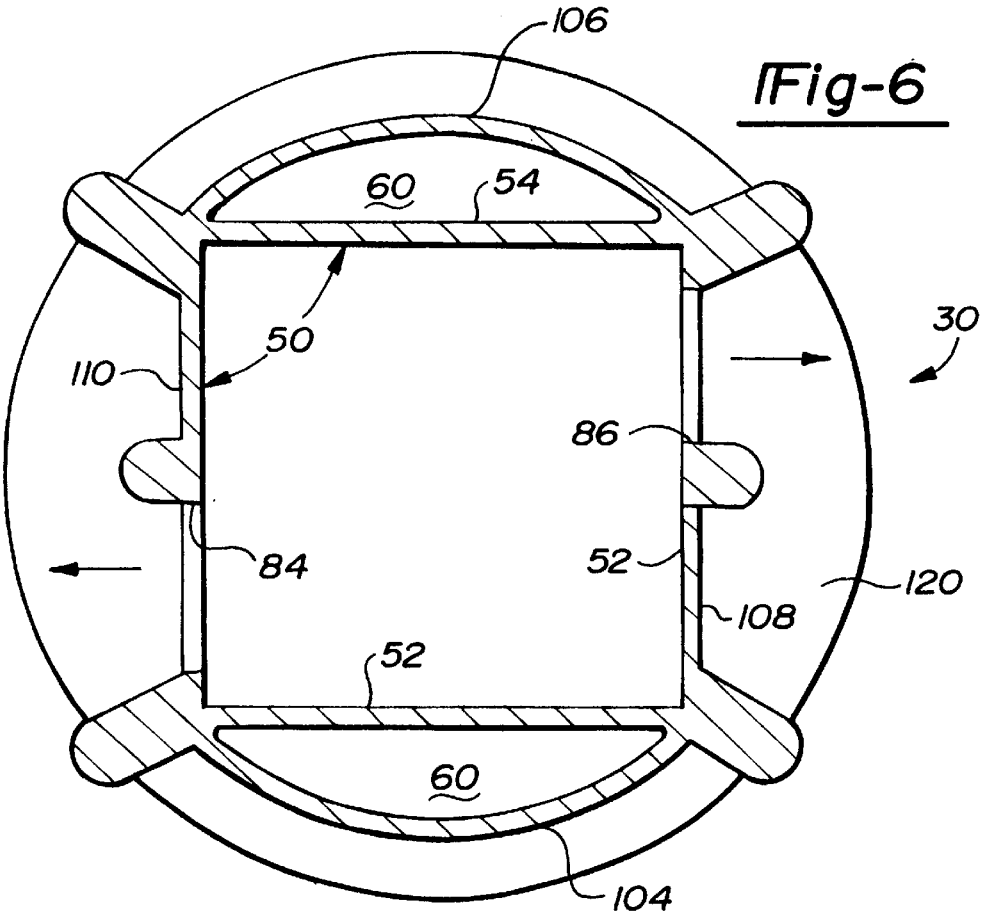
FIG. 6 is a cross section taken along the line 6—6 in FIG. 4.
Figure 7:
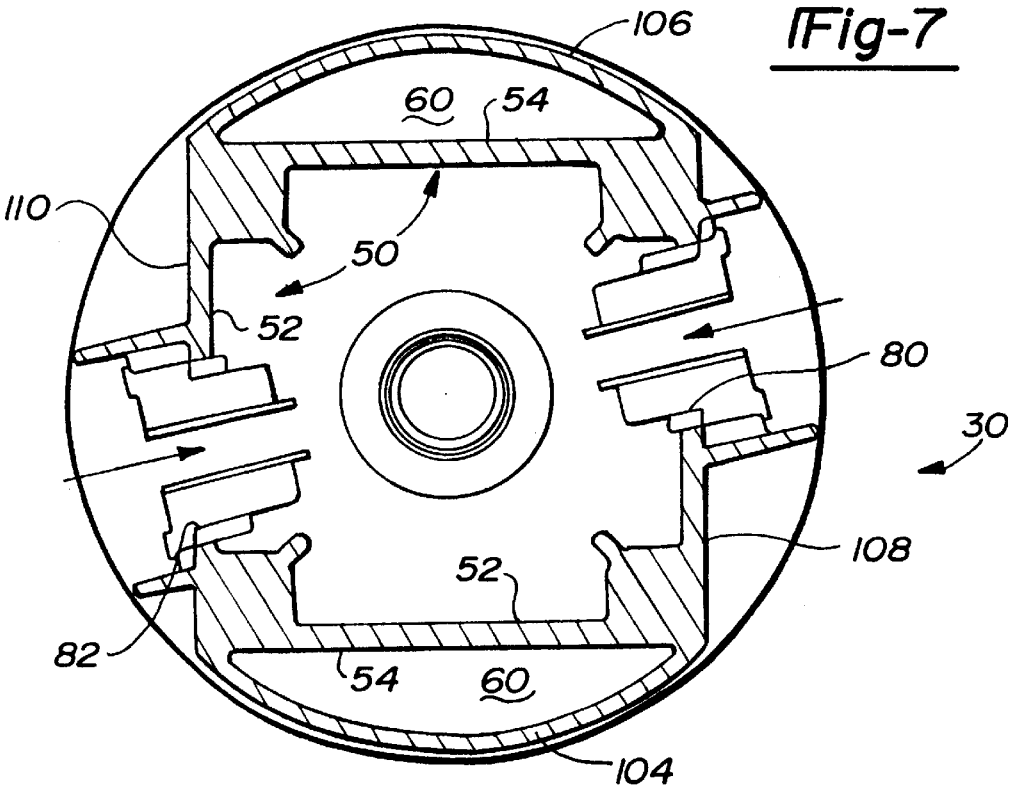
FIG. 7 is a cross section taken along the line 7—7 in FIG. 7.

A pair of venting outlets 84 and 86 are defined at an opposite end of the second portion 48 and preferably are offset from each other (see FIG. 6). The openings for the venting outlets 84 and 86 are at least partially defined in the main housing wall 32. A second fan assembly 88 is supported within the motor chamber 50 and is driven by the motor 56 as it causes the shaft 36 to rotate. As the second fan assembly 88 operates, it draws air into the openings 80 and 82 and creates an air flow 90 that flows through the windings of the motor 56 and exits the motor chamber 50 through the venting outlets 84 and 86. The air flow 90 is the main cooling air flow since it moves through the motor chamber 50 and directly passes over the windings of the motor 56. By providing appropriate inlets or openings (not illustrated) on the vacuum cleaner body 22 and strategically positioning one or more screens or filters along the pathway between the vacuum body 22 and the inlets 80 and 82, it is possible to prevent any debris or an excessive amount of dust particles from moving along the second airway through the motor chamber 50.

Referring now to FIGS. 4 through 7, the preferred embodiment of the motor housing 30 is shown in perspective and cross section to illustrate the preferred contours and arrangement of the various portions of the motor housing 30. The first portion 46 preferably includes a generally cylindrical portion of the main housing wall 32. A cross bar 100 includes a central portion 102 that provide the support for the separator 34 and the sealing components 40–44. The second portion 48 preferably includes an irregularly shaped outside surface. Specifically, a pair of generally curved or rounded sidewalls 104 and 106 are opposite from each other and extend between a pair of generally flat or planar sidewalls 108 and 110. The motor chamber 50 preferably has a generally rectangular cross section over a substantial portion of its length. The end of the motor chamber that faces toward the first portion 46 of the housing 30 preferably is somewhat rounded in contour and converges as a bottleneck toward the circular portion 102.

The motor chamber 50 is defined within the motor housing main wall 32. The two sidewalls 108 and 110 of the motor chamber 50 are coincident with and the same as the sidewalls 108 and 110 of the overall motor housing 30. In other words, the exterior surface 54 on the motor chamber 50 is the same as the exterior surface on the two sidewalls 108 and 110. The sidewalls 104 and 106 are spaced radially outward from the exterior surface 54 on the corresponding sidewalls of the motor chamber 50. The spacing between sidewalls 104 and 106 and the exterior surface 54 on the motor chamber 50 defines the first airway 60 through which the working airflow 76 passes during vacuum cleaner operation. Since the working air flow 76 passes along at least a portion of the exterior surface 54 of the motor chamber 50, it provides a secondary cooling effect for the motor 56. The preferred embodiment of this invention, therefore, places the main fan assembly 72 above (according to the drawings) the motor chamber 50 so that the working air flow flows along the exterior surface 54 of the motor chamber 50 prior to being exhausted through the fan assembly itself.

Figure 4:
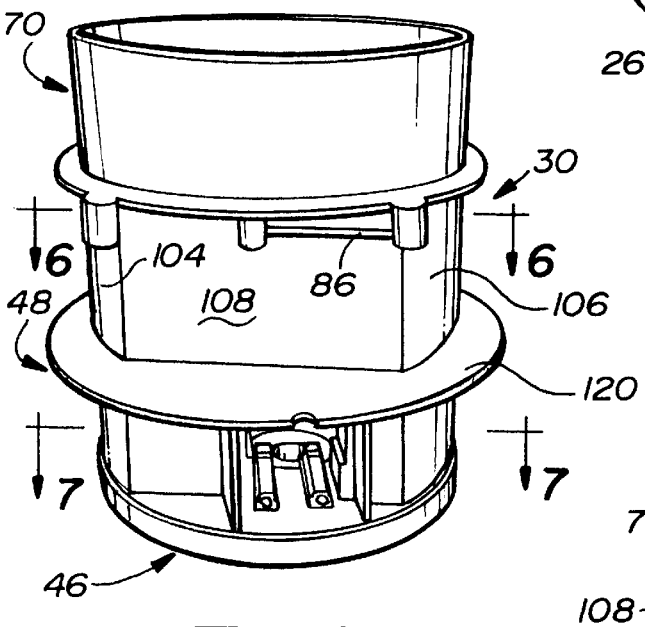
FIG. 4 is a side perspective view of the currently preferred embodiment of the motor housing.
Figure 5:
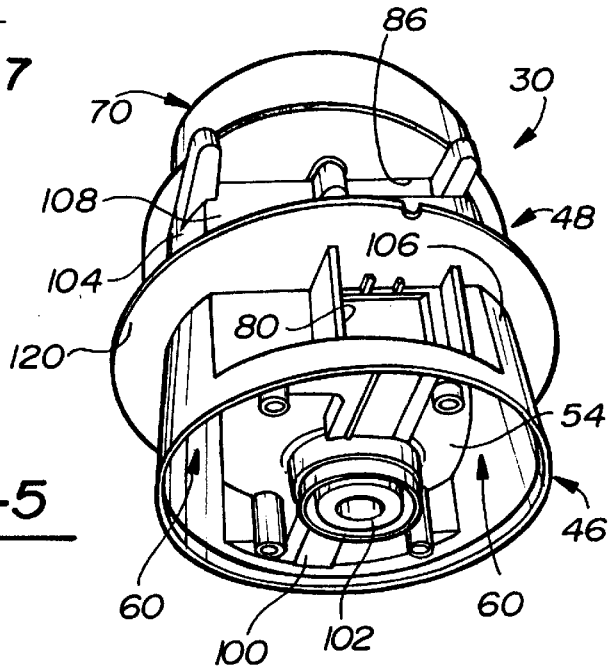
FIG. 5 is a perspective view of the embodiment of FIG. 4 as seen from the lower portion of FIG. 4.

As best seen in FIGS. 4 and 6, for example, the venting outlet 86 is off-center on the sidewall 108. The venting outlet 84 on the sidewall 110 is similarly off-center relative to the center of that sidewall. Further, the venting outlets 84 and 86 preferably are offset from each other. This arrangement provides a more efficient cooling air flow through the motor chamber 50. In fact, the preferred embodiment provides the same cooling effect as prior designs using a reduced air flow. In one embodiment, the motor housing designed according to this invention achieves the same amount of motor cooling as other designs while using only 75% of the air flow. Specifically, it has been determined that a flow of 12 cubic feet per minute of air flow through the motor housing 50 has the same cooling effect as 16 cubic feet per minute in other designs. The more efficient cooling operation of this invention is enhanced by having the first airway 60 provided so that the working air flow 76 moves along the outer surface 54 of the motor chamber 50. Therefore, this invention provides an arrangement where efficient motor cooling is achieved while requiring less air flow and, therefore, using less energy. This provides the further advantage of being able to use a wider variety of components for the second fan assembly 88, for example.

The second portion 48 of the housing 30 preferably includes a radially outwardly extending flange 120 that serves as a motor housing mount that is supported within the vacuum cleaner body 22. Given this description, those skilled in the art will be able to provide a suitable mounting arrangement to maintain the motor housing 30 within a desired position within the vacuum cleaner body 22.

The preceding description is exemplary rather than limiting in nature. Variations and modifications to the disclosed embodiment may become apparent to those skilled in the art that do not necessarily depart from the purview and spirit of this invention. The scope of legal protection given to this invention is to be limited only by the following claims.

The following is claimed:

1. A motor housing for a vacuum cleaner comprising:

a main housing wall having a first generally open end and a second generally open end, said main housing wall defining an outer perimeter of said housing;

a motor chamber supported within said main housing wall, said motor chamber having an inlet and a plurality of venting outlets located on opposite sides of said motor chamber, wherein all of said venting outlets are offset from each other with respect to the longitudinal axis of said motor chamber;

a first airway disposed between an interior surface on said main housing wall and an exterior surface on said motor chamber, said first airway permitting airflow from said first end toward said second end; and a second airway within said motor chamber that is isolated from said first airway and permits airflow from said inlet through said motor chamber toward said venting outlets.

2. The motor housing of claim 1, wherein a portion of said motor chamber and said main housing wall are integral with each other and wherein said motor chamber inlet and venting outlets are formed as openings in side portions of said main housing wall.

3. The motor housing of claim 1, wherein said main housing wall includes a first portion at said first end that is generally cylindrical, a second portion extending from said first portion, said second portion including two generally planar sidewalls and two generally curved sidewalls and a third portion extending between said second portion and said second end, said third portion being generally cylindrical.

4. The motor housing of claim 3, further comprising a support surface extending outward and away from said main housing wall.

5. The motor housing of claim 3, wherein said motor chamber is generally rectangular in cross section and includes first and second motor chamber sidewalls that are opposite from each other and are coincident with said main housing second portion generally planar sidewalls and third and fourth sidewalls that are positioned interiorly from said second portion generally curved sidewalls such that said first pathway includes two conduits that extend between an exterior surface on said motor chamber third and fourth walls and the interior surface on said generally curved sidewalls of said main housing wall second portion.

6. The motor housing of claim 3, wherein a portion of said motor chamber and said main housing wall are integral with each other at said generally planar sidewalls of said main housing wall second portion and wherein said motor chamber inlet and venting outlets respectively comprise openings in said generally planar sidewalls of said main housing wall second portion.

7. The motor housing of claim 3, wherein said first portion is adapted to support a separator device that separates debris disposed in air drawn toward the separator device from air allowed to pass into said motor chamber inlet, wherein said motor chamber is within said second portion and wherein said third portion comprises a stage housing portion that is adapted to support a fan assembly that causes airflow through said first airway.

8. A vacuum cleaner device, comprising:

a body portion;

a debris collection portion supported at one end of said body portion including an inlet through which air and other substances are drawn into said debris collection portion;

a fan assembly operative to cause airflow within said device such that air and other substances are drawn into said debris collection portion inlet;

a motor that is operative to drive said fan assembly; and a housing supported within said body portion having a first end adjacent said debris collection portion, a motor chamber adjacent said first end and a stage portion between said motor chamber and a second end of said housing, said housing further having a main housing wall having a first generally open end and a second generally open end, said main housing wall defining an outer perimeter of said housing, said motor chamber being supported within said main housing wall, said motor chamber having an inlet and venting outlet, a first airway disposed between an interior surface on said main housing wall and an exterior surface on said motor chamber, said first airway permitting airflow from said first end toward said second end, and a second airway within said motor chamber that is isolated from said first airway and permits airflow from said inlet through said motor chamber toward said venting outlet;

said motor being supported in said motor chamber and said fan assembly being supported within said stage portion such that said fan assembly is adjacent said motor but distal from said debris collection portion.

9. The device of claim 8 wherein said motor chamber includes two venting outlets on opposites sides of said motor chamber.

10. The device of claim 9, wherein each said venting outlet is located on a sidewall of said motor chamber and offset from each other with respect to the longitudinal axis of said motor chamber.

11. The device of claim 8, wherein a portion of said motor chamber and said main housing wall are integral with each other and wherein said motor chamber inlet and venting outlet are formed as opening are formed as openings in side portions of said main housing wall.

12. The device of claim 8, wherein said motor chamber has four generally flat sidewalls and wherein said main housing wall includes two generally rounded side wall portions extending generally parallel to and aligned with two of said motor chamber sidewalls such that said first airway is defined within two conduits existing between an exterior surface of said two motor chamber sidewalls and an interior surface on said two generally rounded side wall portions of said main housing wall.

13. The device of claim 12, wherein a portion of said main housing wall is coincident with the other two of said four motor chamber sidewalls.

14. A vacuum cleaner device, comprising:

a body portion;

a debris collection portion supported at one end of said body portion including an inlet through which air and other substances are drawn into said debris collection portion;

a housing supported within said body portion including a first end adjacent said debris collection portion, a motor chamber supported within said housing adjacent said first end, said housing having an interior surface and an exterior surface, and a fan stage adjacent said motor chamber at a second end of said housing that is opposite from said first end, said housing including a first airway permitting airflow along a portion of said exterior surface of said motor chamber and through said housing, and a second airway permitting airflow within and through said motor chamber;

a first fan assembly supported by said fan stage;

a motor supported within said motor chamber, said motor operative to drive said first fan assembly to cause airflow through said first airway from said housing first end toward said second end to thereby cause air and other substances to be drawn into said debris collection inlet; and a second fan assembly supported within said motor chamber and operative to cause airflow through said second airway.

15. The device of claim 14, wherein said motor chamber has four generally flat sidewalls and wherein said housing wall includes two generally rounded side wall portions extending generally parallel to and aligned with two of said motor chamber sidewalls such that said first airway is defined within two chambers existing between an exterior surface of said two motor chamber sidewalls and an interior surface on said two generally rounded side wall portions of said housing wall.

16. The device of claim 15, wherein a portion of said housing wall is coincident with the other two of said four motor chamber sidewalls.

17. The device of claim 14, wherein said housing includes a main housing wall and said motor chamber includes four generally planar sidewalls and two inlets and two venting outlets defined through two of said sidewalls and wherein a portion of said main housing wall is separate from and extending generally parallel to two of said motor chamber sidewalls and another portion of said main housing wall is coincident with the other two of said motor chamber sidewalls.

* * * * *